United States Patent [19]

Baus

[11] 4,090,265

[45] May 23, 1978

[54] PARTITION WALL FOR WET CHAMBERS

[76] Inventor: Heinz Georg Baus, Ulmenweg 46, Thun, Switzerland, 3601

[21] Appl. No.: 744,875

[22] Filed: Nov. 24, 1976

[30] Foreign Application Priority Data

Dec. 2, 1975 Germany ..... 2554097
Dec. 2, 1975 Germany ..... 2554098

[51] Int. Cl.[2] ..... A47K 3/4

[52] U.S. Cl. ..... 4/154; 4/149; 4/153; 49/409; 49/410

[58] Field of Search ..... 4/154, 155, 146, 153, 4/148; 49/409, 410, 411

[56] References Cited

U.S. PATENT DOCUMENTS

| | | | |
|---|---|---|---|
| 3,000,016 | 9/1961 | Ridge | 4/149 |
| 3,107,361 | 10/1963 | Glutting, Sr. | 4/149 |
| 3,282,328 | 11/1966 | Mushro et al. | 4/149 X |
| 3,334,442 | 8/1967 | Boettcher | 49/410 X |
| 3,346,993 | 10/1967 | Johnson | 49/409 |
| 3,365,684 | 1/1968 | Stemke et al. | 4/149 X |
| 3,382,507 | 5/1968 | Micheau | 4/149 |
| 3,384,998 | 5/1968 | Abramson | 49/411 |
| 3,500,481 | 3/1970 | McKwane | 4/149 |
| 3,854,165 | 12/1974 | Haley | 49/410 X |
| 3,896,508 | 7/1975 | Doan | 4/149 |

*Primary Examiner*—Henry K. Artis
*Attorney, Agent, or Firm*—Herbert L. Lerner

[57] ABSTRACT

A partition wall for wet chambers, particularly for bathrooms or stall showers with several wall panels which are slidable either with each other or with respect to each other with each wall panel suspended in an upper guide rail with sliding or roller guides and with the lower guide ledges of the panels guided in a lower closed guide member, shaped with step-like guide rails on top of each other. In a preferred form the upper suspension of each wall panel is positioned outside the line of the center of gravity of the wall panel.

15 Claims, 5 Drawing Figures

FIG.4
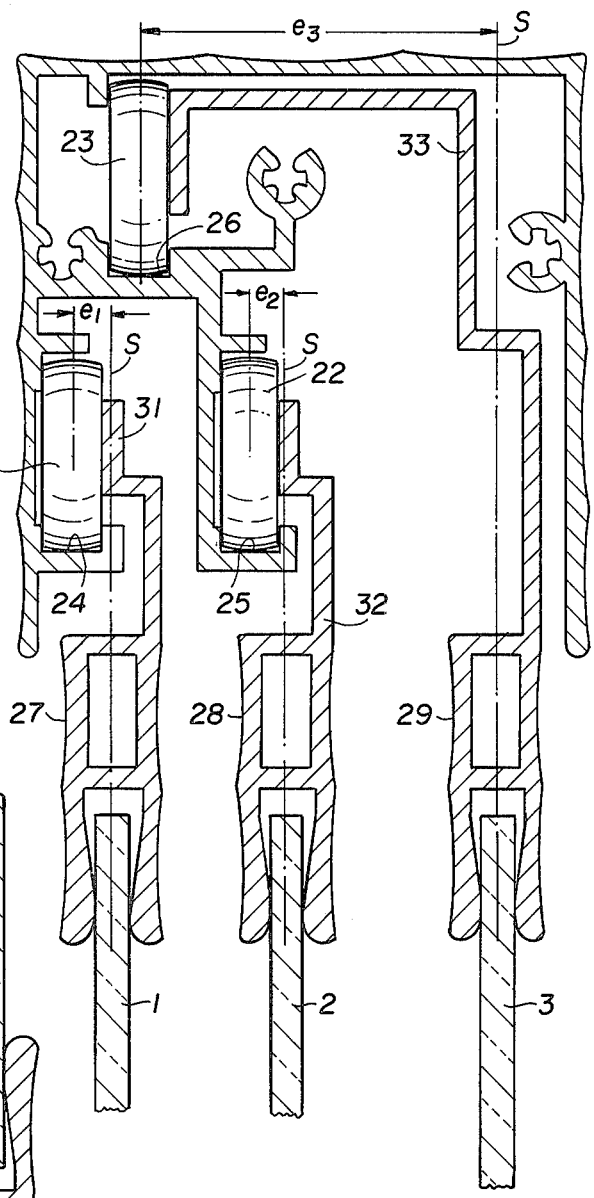
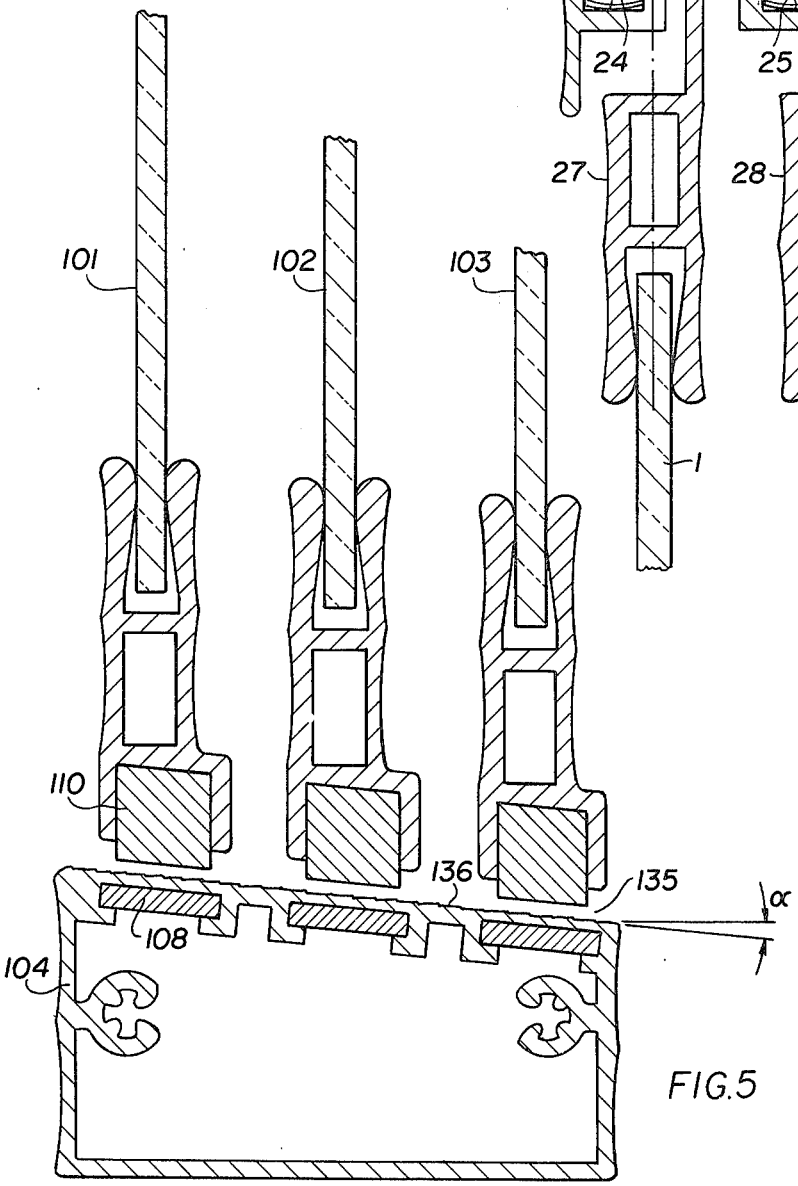
FIG.5

PARTITION WALL FOR WET CHAMBERS

BACKGROUND OF THE INVENTION

1. Field of the Invention

This invention relates to a partition wall for wet chambers and more particularly refers to a new and improved partition wall having several slidable wall panels with each panel suspended in an upper guide rail and guided at its lower end in a lower guide member.

2. Description of the Prior Art

A partition wall for wet chambers, particularly for bathrooms or stall showers with several wall panels which are slidable either with each other or with respect to each other is known. Partition walls of this type serve as water splash protection in bathrooms or in saunas, for example, and in particular are used as shielding placed on the edge of bathtubs or shower tubs.

A known partition wall of this type as described in U.S. Pat. No. 3,500,481 has a closed lower guide member which can possibly be a part of the frame of the tub. It is also generally known to place this guide member onto the edge of the tub, for example, at the installation of the partition at a later date. The known guide member shows "cascade-like" guide rails i.e. the guides are arranged in steps slanting down towards the side of the tube for preventing the escape of water spray into the dry room. To stabilize the slidable wall panels against forces perpendicular to the plane of the panel, they are provided at their lower ends with rollers which are secured on studs, with their turning axes parallel to the wall panels and guided in U-shaped guide rails in the lower guide member which rails are open toward the bottom. If the number of sliding wall panels is increased, the studs which carry the guide rollers get longer accordingly. Furthermore, a relatively complicated cross-section profile for the lower guide member results from the U-shaped guides which are open toward the bottom, which is undesirable with respect to cleaning of the lower guide rail.

SUMMARY OF THE INVENTION

An object of the present invention is to provide a partition wall for wet chambers of improved design in which the guide member as well as the lower portion of the wall panel have little or no overhanging parts and parts protruding to the outside.

With the foregoing and other objects in view, there is provided in accordance with the invention a partition wall for wet chambers particularly for bathrooms or stall showers having several slidable wall panels with each wall panel suspended in an upper guide rail and with each wall panel having a lower guide ledge guided in a lower closed guide member, the lower closed guide member being shaped with steplike guide rails one above the other, the wall panels having permanent magnets installed in the lower guide ledges of the wall panels, the guide rails having keeper means, and each wall panel disposed against a surface of a rail guide and held by magnetic force resulting from the attraction of the premanent magnets and the keeper means, in a direction perpendicular to the plane of the wall panel, and guided at the surface.

In a further embodiment of the invention there is provided a partition wall for wet chambers, particularly for bathrooms or stall showers having several slidable wall panels with each wall panel suspended in an upper guide rail, and with each wall panel having a lower guide ledge guided in a lower closed guide member with at least two guiding means and limiting walls, each wall panel having its upper suspension positioned outside the line of the center of gravity of the wall panel and each wall panel having its lower guide ledge braced against a limiting wall of the lower guide member, at an angle to the plane of the panel and held by permanent magnets against the limiting wall.

BRIEF DESCRIPTION OF THE DRAWINGS

Other features which are considered as characteristic for the invention are set forth in the appended claims.

Although the invention is illustrated and described herein as embodied in partition wall for wet chambers, it is nevertheless not intended to be limited to the details shown, since various modifications may be made therein without departing from the spirit of the invention and within the scope and range of equivalents of the claims.

Figure 1:
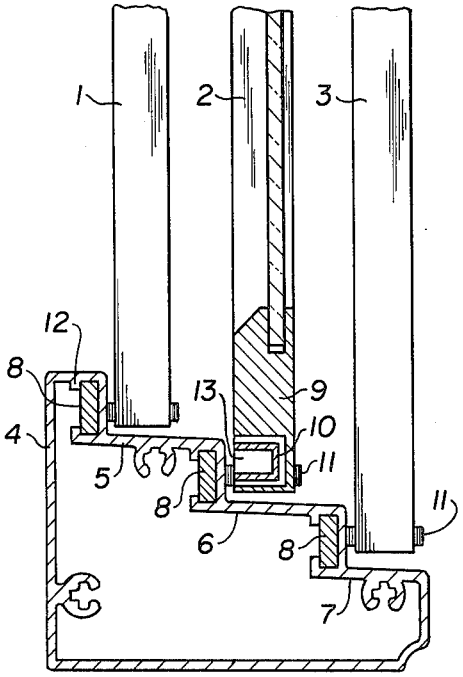
Figure 2:
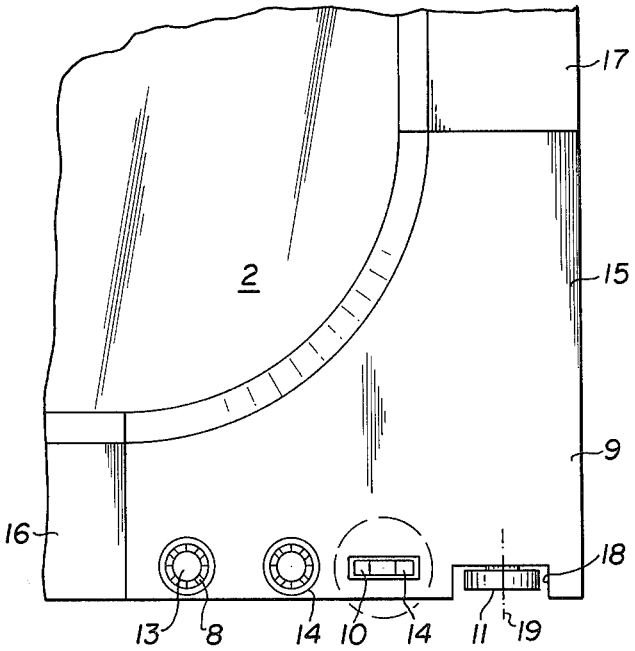
Figure 3:
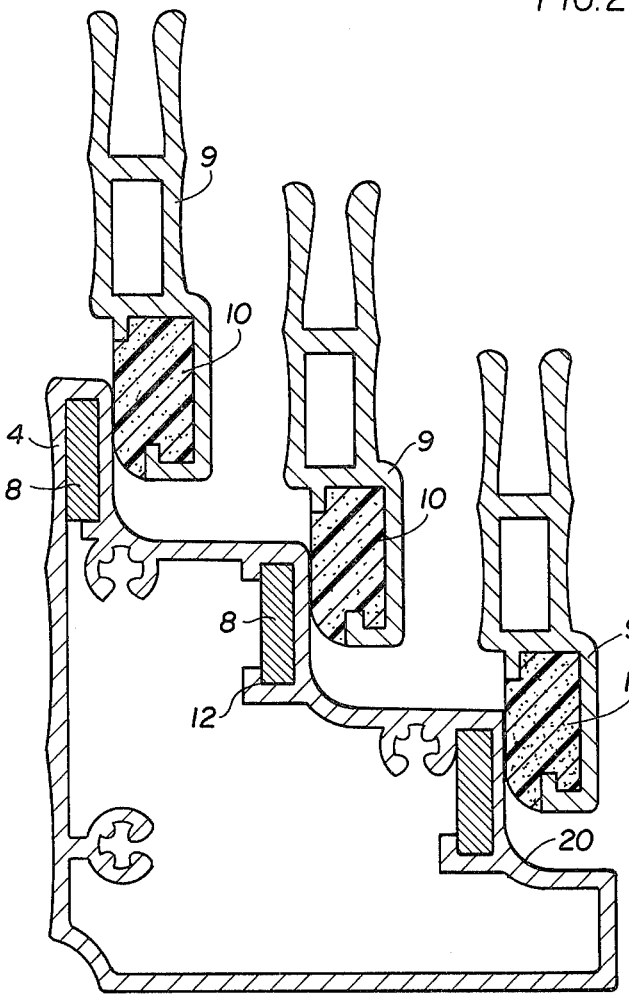

The invention, however, together with additional objects and advantages thereof will be best understood from the following description of specific embodiments when read in connection with the accompanying drawings, in which:

FIG. 1 is a sectional view of the lower guide member, and a partition wall in the area of the lower guide member transverse to the direction of the guides; and FIG. 2 is a view of a corner of one of the wall panels shown in FIG. 1; and FIG. 3 is a modification of the partition wall shown in FIG. 1; and FIG. 4 is a view of the partition wall with a special upper suspension shown in section; and FIG. 5 is another embodiment of the lower guide member and partition wall in the area of the lower guide member shown in FIG. 1.

DETAILED DESCRIPTION OF THE INVENTION

A first approach to avoiding as much as possible overhanging parts and parts protruding to the outside, in the guide member as well as in the lower portion of the wall panel, according to the invention, is achieved by installing permanent magnets into the lower guide ledges of the wall panels and providing the guides with keeper means and by holding and guiding each wall panel by magnetic force against a surface of its guide. Thus, a strictly magnetic guiding arrangement with one-sided surface contact is achieved. The lower guide member can be of simple shape and can be easily kept free of dirt. Though the use of permanent magnets itself, for a hanging sliding door is known (German Published Non-Prosecuted Application No. 1,584,025), however, in the known case, the permanent magnets in the lower guide arrangement oppose each other with poles of equal polarity in the lower guide ledge of the sliding door on one side and in the lower guide member on the other side, so that in the ideal case, a "floating condition" results due to the repelling forces. This means that, in the known case, the permanent magnets function as an aid to lift a heavy door, but not as a guiding device at a single side of each wall panel, as in the present invention.

A further approach is achieved by disposing the upper suspension of each wall panel outside of the line of the center of gravity of the panel and by banking the wall panel along a limiting wall in the lower guide member and holding it by permanent magnets against the limiting wall.

The magnetic force which has been described for the first approach, is advantageously augmented by the turning moment around the upper suspension for a secure bearing contact at the respective guide surface.

In the second approach, the wall panels cannot be described as "free hanging" because due to the upper suspension and the lower bearing arrangement, a different relationship of forces exists as in the first-mentioned approach where the weight causes no moment with respect to the wall panel and the magnetic force only serves for cross-stabilization.

In an arrangement with step-like guides on top of each other in the lower guide member, the permanent magnets are disposed at the vertical surfaces of the steps, and are guided in the latter.

Advantageously, a lower guide member can be realized by the arrangement according to the invention, with an upper side which is shaped in steps. The surface of the steps consists basically of vertical and horizontal surfaces which continuously blend into each other, and has a total slant toward the wet chamber or tub in contrast to the arrangement described as well-known (U.S. Pat. No. 3,500,481) where strips with an L-shaped cross section are provided at the horizontal wall members which, together with the vertical wall members, form the U-shaped guides which are open at the bottom.

Advantages of the construction according to the invention are the surprisingly simple profile shape and the optimal hygienic condition, since lime deposits and bacteria can hardly take hold and the smooth surface is easy to clean. Protection against water spray is assured by the stepped profile. The magnetic force for cross-stabilization can be relatively small, so that the permanent magnets which are conventional in the furniture industry and commercially available, are suitable for installation into the wall panels. The keepers for the magnets (anchor members) are disposed in the guide member. The arrangement of the permanent magnets and the keepers can also be reversed i.e. the first-mentioned are in the guide member and the latter in the wall panels. However, in comparison, the first-mentioned arrangement has the advantage that only single permanent magnets need be arranged in portions of the slidable wall panels.

In a variation of the arrangement according to the invention, the lower guide ledge can be provided with guide rollers in addition to the permanent magnets. The turning axes of the rollers are parallel to the plane of the panel.

In contrast to the known arrangement (U.S. Pat. No. 3,500,481) which has been described in the beginning, the system at hand lends itself readily to increasing the number of slidable wall panels without the necessity of providing objectionable overhanging studs for the guide rollers. Rather, the guide rollers can be disposed in a recess of the lower guide ledge alongside the permanent magnets or keeper means with the turning axes of the guide rollers parallel to the plane of the panel.

Iron members with a U-shaped cross-section are suitable as permanent magnets with their longitudinal axis aligned across the plane of the panels, and with their open side directed toward the steps and with the other closed side disposed inside the recesses of the wall panel. This construction results, advantageously, in a small magnetic resistance. There are no parts with magnetic resistance interposed and no protruding parts.

Advantageously, the permanent magnets or the keeper means and guide rollers are located in a lower portion of the right angle frame of the wall panel, which simultaneously also serves as its corner connection. This arrangement permits the combination with the presently conventional frame parts i.e. the right-angled frame member is simply pushed together with two conventional profiles, as for example by connecting a stiffener member in each profile. A miter joint with interfering outer frame corners is avoided.

Also included are the cases where the wall panels are held against the steps by magnetic force at right angles to the plane of the panel, the cases with slightly inclined step surfaces and/or keeper means respectively, and permanent magnets in various arrangements in relation to the step surfaces. The design of the partition wall unit is such that the direction of the magnetic force is substantially perpendicular to the plane of the panel.

In the simplest case, the lower guide member has as guide and upper limiting wall, a surface which is slightly inclined with respect to the horizontal, and slanting toward the wet chamber, and preferably knurled on the surface.

The permanent magnets consisting at least in part of plastic with permanently magnetized inclusions, finely dispersed in the plastic, have good practical application. The use of such magnets greatly simplifies fastening to the panel wall, also the plastic magnets have a small sliding friction at the steps of the guide member.

If conventional permanent magnets are used and/or keeper means, they are desirably coated with plastic. In addition to the reduced friction, this coating also protects against corrosion.

For the adjustment of the air gap the permanent magnets and/or the keeper means and/or the guide rollers can be made adjustable vertically to the panel-plane, or obliquely in the case of a slightly slanted guide surface and can be made so that they can be locked in the middle position.

Furthermore, they can be mounted with a swivel feature to compensate for slight unevenness and parallelity deviations between the guide-strip and the step surface, or the limiting surface.

In both cases — adjustability, hingeability — the permanent magnets or the keeper means can extend somewhat beyond the plane of the lower guide strip and serve as stop for the gliding distance. The distance can be set for less than one millimeter without difficulty. This applies also when guide rollers are used in addition to the permanent magnets or keeper means.

Referring to FIG. 1 there is shown a partition wall with three slidable wall panels 1, 2 and 3. The lower guide member 4 is provided with three steps 5, 6 and 7 in relation to panels 1, 2 and 3. The keeper means 8 are disposed within these steps 5, 6 and 7, and may be shaped as through running rails. The wall panels 1, 2 and 3 contain, in their lower guide ledges 9, inserted permanent magnets 10. The guide rollers 11 are positioned adjacent permanent magnets 10.

In the vertical walls of the steps 5, 6 and 7 are provided fitted openings 12 for receiving the keeper means 8 which openings can be easily produced in the extrusion process used to manufacture the lower guide member 4.

The permanent magnets 10 have either a U-shaped or horseshoe-shaped cross-section (FIG. 1, FIG. 2). If the keeper means 8 are disposed in the wall panels 1, 2 and 3, then hollow cylindrical iron parts can serve as keeper means 8. The parts are positioned with their cylinder axis at right angles to the plane of the wall panel, pointing with their open side 13 toward the vertical walls of the steps 5, 6 and 7, and with the other closed side positioned in recesses 14 of the wall panels 1, 2 and 3.

FIG. 2 shows the arrangement of the keeper means 8 or the permanent magnets 10 and a guide roller 11 in a lower portion of the right angle frame 15 of wall panel 2. Frame member 15 also forms the corner connection. The right angle frame member 15 can be easily connected to the horizontal and the vertical frame parts 16 and 17, and carries advantageously all the parts necessary for the lower guides. The guide roller 11 is arranged in recess 18 so that its turning axis 19 is parallel to the plane of the panel.

In a preferred embodiment (FIG. 3), the permanent magnets 10 consist of a permanently magnetized plastic i.e. a plastic with inclusions of finely dispersed metal particles that can be magnetized. Alternatively the magnets 10 can also be coated with plastic, as mentioned. The magnets 10 are located in the guide ledges 9 and slide directly along the vertical surfaces of the steps. The transitions between the vertical-horizontal surfaces of the steps can be formed by part-circle areas 20.

In FIG. 4, an embodiment of the upper suspension is shown. The wall panels 1, 2 and 3 are supported outside of their line of center of gravity with a fixed eccentricity $e_1$, $e_2$, $e_3$ on upper guide rollers 21, 22, 23 in the upper guides 24, 25, 26. The upper frame members 27, 28, 29 of the wall panels 1, 2, 3 are provided with suitable holders 31, 32, 33 for the guide rollers 21, 22, 23, whereby holder 33 reaches above the identically shaped holders 31 and 32. Guide roller 23 is disposed above the adjacent guide rollers 21, 22. Due to the eccentric support a turning moment is generated around the support or roll-off point of the guide rollers 21, 22 and 23 which is compensated at the lower guides (see FIG. 1). The wall panels are thus stabilized to forces perpendicular to the wall plane and form, at the bottom, in conjunction with the steps 5, 6 and 7 of the lower guide member 4 a protection against water spray.

As already mentioned, additional permanent magnets can be provided in the lower guides for stabilization in the transverse direction (according to FIG. 3). In a further development of the instant invention, the permanent magnets 10 or the keeper means 8, i.e. means for attracting the panel or adjacent member by magnetic force, and/or the guide rollers 11 can be arranged in their respective recesses 14 or 18 in such a manner that they are adjustable perpendicularly to the plane of the wall and capable of being secured in the desired position (not shown).

Furthermore, the wall panels 1, 2, 3 can be made in a single part i.e. the guide ledge 9 and the frame members are an integral unit including the inserted translucent panes.

Also, the guide rollers 11 can be made as permanent magnets with inner and outer poles and the permanent magnets 10 can be omitted. This construction is technically especially advantageous, since it combines the magnetic guiding with minimal frictional resistance.

If the guide member 4 is not made as usual of aluminum or plastic, but for example of a ferromagnetic material, then the keeper means can be omitted.

A further simplification can be achieved by an embodiment wherein the upper surface 136 of the lower guide member 104 (FIG. 5) is made mainly in one plane, slightly slanting toward the side of the tub i.e. without steps and forming and angle $\alpha$ to the horizontal. The keeper means 108 are disposed under the upper limit wall 135 of the guide member 104, or are recessed in the latter. The wall panels 101, 102, 103 and/or the magnets 110 carried by them are slanted at the bottom, and the magnets 110 are recessed into the bottom sides of the wall panels or cemented to the latter.

In the latter case, gaps between the magnets 110 are closed by cemented sealing strips or sealing pads (not shown). A slightly knurled finish 135 in the direction of the guide may be provided so that the coefficient of friction is greater in the transverse direction than in the direction of the guide. In this version either the magnetic force alone, or the moment existing due to the eccentric suspension or the combination of both can effect the transverse stabilization. Thereby an advantageously simple profile form of the lower guide member 4 is achieved with a trade-off with regard to a somewhat decreased protection against water spray.

In all variations, the permanent magnets 10 or the keeper means 8 can be made to swivel or hinge, so that an automatic tolerance compensation of the lower guide member 4, 104 or the lower guide ledge 9 is easily achieved for unevenness and for small manufacture- and assembly tolerances.

There are claimed:

1. Partition wall for wet chambers particularly for bathrooms or stall showers having several slidable wall panels with each wall panel suspended in an upper guide rail and with each wall panel having a lower guide ledge guided in a lower closed guide member, said lower closed guide member being shaped with steplike guide rails one above the other and having one continuous upper surface with said lower guide ledge disposed above the upper surface of the steplike guide rails, said wall panels having permanent magnets installed in said lower guide ledges of the wall panels, said guide rails having keeper means, and each wall panel disposed against a surface of a guide rail and held by magnetic force resulting from the attraction of said permanent magnets and said keeper means, in a direction perpendicular to the plane of the wall panel, and guided at said surface.

2. Partition wall for wet chambers, particularly for bathrooms or stall showers having several slidable wall panels with each wall panel suspended in an upper guide rail and with each wall panel having a lower guide ledge guided in a lower closed guide member with at least two guiding means and limiting walls, each wall panel having its upper suspension positioned outside the line of the center of gravity of the wall panel, and each wall panel having its lower guide ledge braced against a limiting wall of the lower guide member at an angle to the plane of the panel and held by permanent magnets against said limiting wall, and wherein said lower guide member has steplike guides on top of each other as one continuous upper surface with said lower guide ledge disposed above the upper surface of the steplike guide, and wherein the permanent magnets are adjacent the vertical surfaces of said steps and are guided along the vertical surfaces.

3. Partition wall according to claim 1 wherein said lower guide ledge has guide rollers with the turning axes of said rollers parallel to the plane of the panel.

4. Partition wall according to claim 1 wherein said permanent magnets are iron parts with a U-shaped cross section, which iron parts are oriented with their longitudinal axis perpendicular to the plane of the panel and pointing with their open side toward the steps of said steplike guide rails and the other closed side of said iron parts are disposed in recesses of said wall panel.

5. Partition wall according to claim 3 wherein the permanent magnets and the guide rollers are located in a lower right-angled frame member of the wall panel which frame member also serves as corner connector.

6. Partition wall according to claim 3 wherein said guide rollers are permanent magnets with inner and outer poles.

7. Partition wall according to claim 1 wherein said permanent magnets are arranged perpendicularly to the plane of the panel with means for adjusting and securing the magnets in position.

8. Partition wall according to claim 3 wherein said guide rollers are arranged perpendicularly to the plane of the panel with means for adjusting and securing the guide rollers in position.

9. Partition wall according to claim 1 wherein the lower guide member has a top surface as guiding- and upper limiting wall which top surface is slightly inclined with respect to the horizontal and slants toward the wet chamber.

10. Partition wall according to claim 9 wherein said inclined surface is knurled.

11. Partition wall according to claim 1 wherein said keeper means are in the form of through running rails and are disposed within the closed guide member.

12. Partition wall according to claim 1 wherein the permanent magnets are made of a plastic with finely dispersed permanently magnetized material incorporated in the plastic.

13. Partition wall according to claim 1 wherein the keeper means are coated with a plastic material.

14. Partition wall according to claim 1 wherein the permanent magnets are hingeably mounted.

15. Partition wall for wet chambers particularly for bathrooms or stall showers having several slidable wall panels with each wall panel suspended in an upper guide rail and with each wall panel having a lower guide ledge guided in a lower closed guide member, said lower closed guide member being shaped with steplike guide rails one above the other and having one continuous upper surface with said lower guide ledge disposed above the upper surface of the steplike guide rails, said wall panels having keeper means installed in said lower guide ledges of the wall panels, said guide rails having permanent magnets, and each wall panel disposed against a surface of a guide rail and held by magnetic force resulting from the attraction of said permanent magnets and said keeper means, in a direction perpendicular to the plane of the wall panel, and guided at said surface.

* * * * *